US005486021A

United States Patent [19]

Laurash

[11] Patent Number: 5,486,021

[45] Date of Patent: Jan. 23, 1996

[54] LABEL FOR OPERATION CONTROL SYSTEM

[75] Inventor: David F. Laurash, Bellbrook, Ohio

[73] Assignee: The Standard Register Company, Dayton, Ohio

[21] Appl. No.: 276,262

[22] Filed: Jul. 18, 1994

Related U.S. Application Data

[63] Continuation of Ser. No. 961,377, Oct. 15, 1992, Pat. No. 5,383,686.

[51] Int. Cl.[6] ..... B42D 15/00

[52] U.S. Cl. ..... 283/81; 283/101

[58] Field of Search ..... 283/79, 80, 81, 283/101, 95, 96; 40/249; 428/40–43

[56] References Cited

U.S. PATENT DOCUMENTS

| | | | |
|---|---|---|---|
| 3,315,387 | 4/1967 | Heuser . | |
| 3,455,576 | 7/1969 | Hammerling . | |
| 3,508,754 | 4/1970 | Shorin . | |
| 3,524,782 | 8/1970 | Buske . | |
| 3,638,340 | 2/1972 | Gottschalk . | |
| 3,860,796 | 1/1975 | Wallace et al. . | |
| 3,914,483 | 10/1975 | Stipek, Jr. . | |
| 3,987,960 | 10/1976 | Gardiner . | |
| 4,204,706 | 5/1980 | Blum et al. . | |
| 4,231,593 | 11/1980 | Bell, Jr. et al. . | |
| 4,306,367 | 12/1981 | Otto . | |
| 4,379,573 | 4/1983 | Lomeli et al. . | |
| 4,479,838 | 10/1984 | Dunsirn et al. . | |
| 4,572,855 | 2/1986 | Kalus et al. . | |
| 4,821,439 | 4/1989 | Wilck . | |
| 4,846,504 | 7/1989 | MacGregor et al. . | |
| 4,927,179 | 5/1990 | Ehret et al. . | |
| 4,983,438 | 1/1991 | Jameson . | |
| 4,995,642 | 2/1991 | Juszak et al. | 285/79 |
| 5,039,652 | 8/1991 | Doll et al. . | |
| 5,042,842 | 8/1991 | Green et al. . | |
| 5,071,167 | 12/1991 | O'Brien . | |
| 5,262,251 | 11/1993 | Will et al. | 283/81 X |

*Primary Examiner*—Willmon Fridie, Jr.

*Attorney, Agent, or Firm*—Killworth, Gottman, Hagan & Schaeff

[57] ABSTRACT

Multiple ply labels include removable single ply portions for use in facilitating package shipment operations. Two-ply and a three-ply embodiments are disclosed with release material being applied to portions of a second or bottom ply which are overlain by tab portions of a first or top ply having adhesive applied to the underside of the tab portions and around the periphery of the top and bottom plies to adhere the plies to one another to assemble the labels. The tab portions are preferably formed by die cuts; however, lines of weakness created for example by creasing or lines of perforations can be used to make the tab portions readily separable from the top ply. Card portions are also formed by lines of perforations or other lines of weakness in the top ply with the card portions being formed clear of any adhesive coating such that they are free of adhesive for filing, mailing or other applications related to the package shipment operations.

5 Claims, 2 Drawing Sheets

LABEL FOR OPERATION CONTROL SYSTEM

This is a continuation of application Ser. No. 07/961,377 filed Oct. 15, 1992, now U.S. Pat. No. 5,383,686.

BACKGROUND OF THE INVENTION

The present invention relates generally to labels made from two or more plies which are adhered to one another and, more particularly, to laminate labels which include at least one removable portion which can take the form of an adhesive coated label for use in a control system for operation of a business. While the labels of the present invention can be utilized in a number of different business operations including materials handling, inventory control and the like, they are particularly applicable for facilitating package shipping operations and accordingly will be described with reference to this application.

Package shipping operations have become more and more automated as computers have been integrated into systems for monitoring and controlling package handling. Computers maintain a continually updated record of the progress of packages in a delivery channel extending from the shipper to the addressee by receiving data regarding each package at a number of stations along the channel. To facilitate data entry along the package delivery channel, multiple function labels have been developed for replacement of earlier used pocket labels. Multiple function labels reduce the time and effort required to perform data entry and tracking operations to thereby decrease the possibility of mistakes due to human error or negligence.

One such multiple function label, comprising three plies with additional plies optionally provided for office copies or the like, is disclosed in U.S. Pat. No. 4,995,642. This label, however, is relatively expensive to manufacture and results in two substantially different forms of adhesive backed labels which must be removed and applied in correspondingly different manners. The variations in structure add needless complications for users of the multiple function labels which could potentially result in the very types of errors which are sought to be avoided by the use of multiple function labels.

Further, separation of the plies of a two ply label during its removal could result in destruction of the information on the label. Such information loss would completely nullify the advantage of having the label available and could reduce the efficiency of shipment if not discovered while a package was still available. A similar problem could result when using the disclosed single ply label since a portion of the label could be torn off when the label is separated from the removable portion of the top ply of the multiple function label.

Accordingly, there is a need for an improved multiple function label for use in business operations such as materials handling, inventory control, package shipping and the like which is inexpensive to manufacture, convenient and simple to use, and versatile for use in a number of different business environments and applications. Preferably, the improved function label should not only provide one or more adhesive backed single ply labels for the user but also provide one or more adhesive free card portions suitable for mailing, filing or the like for facilitating rapid completion of additional related business functions.

SUMMARY OF THE INVENTION

This need is met by the multiple ply label of the present invention which includes removable single ply portions for use in facilitating business operations such as package shipment. Two-ply and a three-ply embodiments are disclosed with release material being applied to portions of a second or bottom ply which are overlain by tab portions of a first or top ply, having adhesive applied to the underside of the tab portions and around the periphery of the top and bottom plies to adhere the plies to one another to assemble the labels. The tab portions are preferably formed by die cuts; however, lines of weakness created for example by creasing or lines of perforations can be used to make the tab portions readily separable from the top ply. Card portions are also formed by lines of perforations or other weakness in the top ply with the card portions being formed clear of any adhesive coating. Accordingly, the card portions are free of adhesive for filing, mailing or other applications related to the business employing the labels.

In accordance with one aspect of the present invention, a label for use in an operation control system comprises a top ply having its underside coated with an adhesive in a pattern defining a border around the outer periphery of the top ply. The top ply comprises a tab portion formed to be readily separable from the remainder of the top ply preferably by means of a die cut which defines the tab portion. The adhesive is coated onto at least a substantial part of the underside of the tab portion which is adapted to include identification indicia thereon. A bottom ply is adhered to the top ply by the adhesive and has at least a tab release portion of its upper side coated with a release material in areas corresponding to the tab portion of the top ply. By this structure, the tab portion can be separated from the top ply and the bottom ply, and secured elsewhere by means of the adhesive on the underside of the tab portion.

The top ply may further comprise a card portion formed to be readily separable from the remainder of the top ply and having its entire underside excluded from the adhesive pattern. The card portion is defined by a line of weakness to render the card portion readily separable from the top ply. Preferably, the line of weakness comprises a line of perforations in the top ply.

In one embodiment, the release material coated on the upper side of the bottom ply corresponds to substantially the entirety of the adhesive pattern and the tab release portion of the bottom ply is die cut in the bottom ply to be separable from the remainder of the bottom ply. For the illustrated label of this embodiment, the tab release portion of the bottom ply is larger than the tab portion of the top ply.

In another embodiment, the bottom ply has its underside coated with adhesive and further comprises a release liner ply adhered to the bottom ply by the adhesive. The release liner ply has its upper surface coated with release material corresponding substantially to the area of the adhesive coated on the underside of the bottom ply which can cover the bottom ply entirely or a portion thereof.

In accordance with another aspect of the present invention, a label for use in an operation control system comprises top and bottom generally rectangular superposed plies removably adhered to one another around the perimeter of the plies. The top ply has its underside coated with an adhesive in a pattern around the perimeter of the top ply and comprises a tab portion formed to be readily separable from the top ply. The adhesive is also coated onto at least a substantial part of the underside of the tab portion which is adapted to include identification indicia thereon. The bottom ply is removably adhered to the top ply by the adhesive because a portion of its upper side is coated with release material in the area corresponding to the adhesive pattern and including a tab release portion corresponding to the tab portion of the top ply. The tab release portion of the bottom ply is die cut to be readily separable from the bottom ply such that the top ply can be removed from the bottom ply and secured to a surface by the adhesive. Thereafter, the tab portion of the top ply can be separated from the remainder of the top ply and the tab release portion of the bottom ply, and secured elsewhere by means of the adhesive on the underside of the tab portion.

In accordance with yet another aspect of the present invention, a label for use in an operation control system comprises top and bottom generally rectangular superposed plies adhered to one another around the perimeter of the plies. The top ply has its underside coated with an adhesive in a pattern around the perimeter of the top ply and comprising a tab portion formed to be readily separable from the top ply. The adhesive is also coated onto at least a substantial part of the underside of the tab portion which is adapted to include identification indicia thereon. The bottom ply has its underside coated with adhesive and a portion of its upper side corresponding to the tab portion of the top ply coated with a release material. In this way, the tab portion can be separated from the top ply and the bottom ply, and secured elsewhere by means of the adhesive on the underside of the tab portion. A release liner ply is adhered to the bottom ply by the adhesive coated on the underside of the bottom ply. The release liner ply has its upper surface coated with release material substantially corresponding to the adhesive coated on the underside of the second ply.

It is thus an object of the present invention to provide an improved multiple function label for use in business operations such as package shipping which is inexpensive to manufacture and provides one or more cards or secondary labels which can be removed from the multiple function label and applied elsewhere; to provide an improved multiple function label for use in business operations such as package shipping wherein adhesive backed sublabels are die-cut into a top ply to overlay release material coated in corresponding portions of a bottom ply; and, to provide an improved multiple function label for use in business operations such as package shipping wherein at least one readily separable tab portion and at least one readily separable card portion are defined in a top ply with the tab portion having an adhesive underside adjacent a coating of release material in a bottom ply and the card portion being free of adhesive.

Other objects and advantages of the invention will be apparent from the following description, the accompanying drawings and the appended claims.

DETAILED DESCRIPTION OF THE INVENTION

The multiple function label of the present application can be utilized in a number of different business operations including materials handling, inventory control and the like. However, such a label is particularly applicable for facilitating package shipping operations and accordingly will be described herein with reference to this application.

Figure 1:
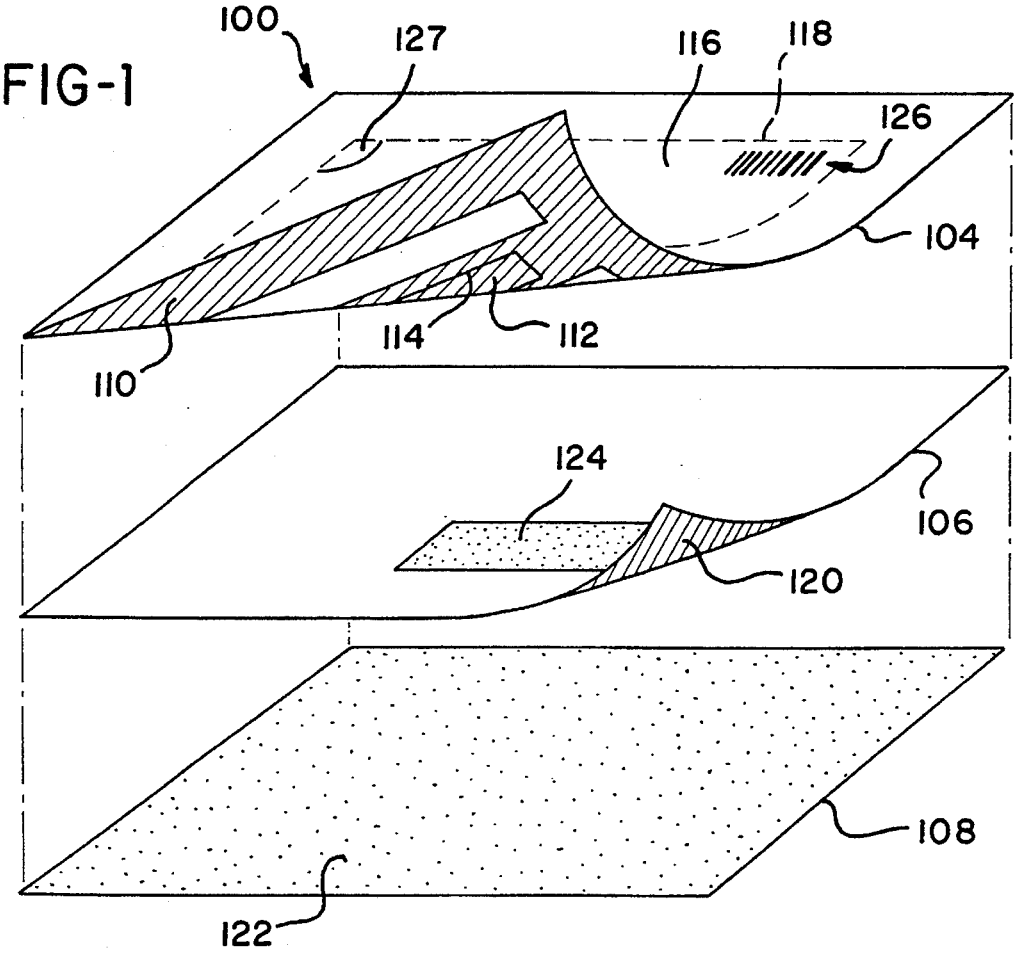
FIG. 1 is an exploded view of a first three-ply embodiment of a label in accordance with the present invention.
Figure 2:
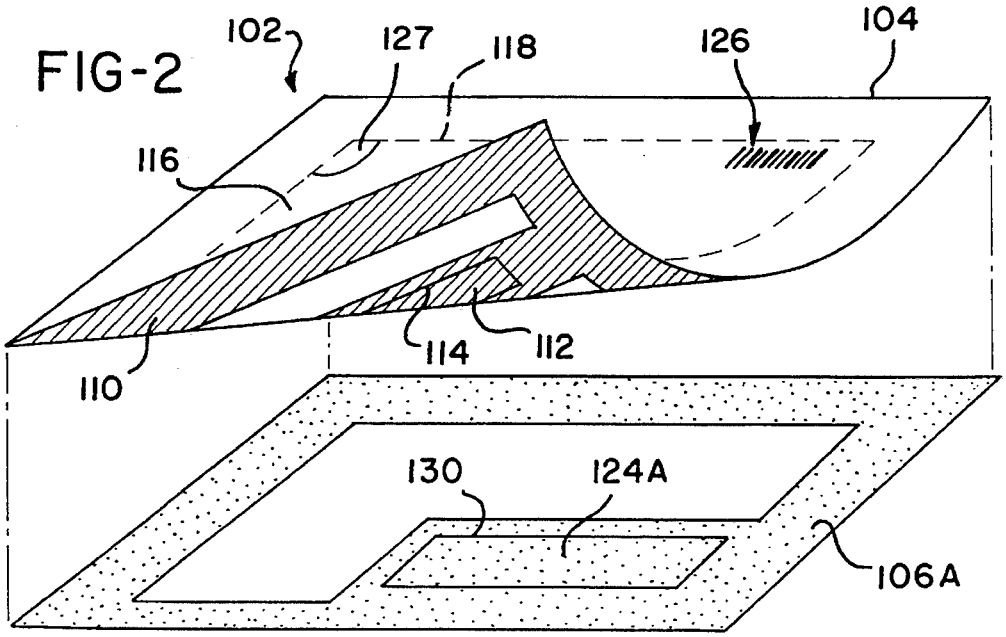
FIG. 2 is an exploded view of a second two-ply embodiment of a label in accordance with the present invention.

Labels 100, 102 constructed in accordance with the present invention and shown, respectively, with plies separated in FIGS. 1 and 2, assist in the automated control, tracking, and recording of package shipping operations. The labels 100, 102 are designed to be inexpensively produced and to perform essential functions of such automated systems. Accordingly, the labels 100, 102 reduce the time and effort of manual operations to reduce the possibilities for human error and negligence and thereby provide improved efficiency and accuracy.

A desirable feature of the labels 100, 102 is that they include sections or portions which can be removed from the remainder of the labels. The portions which are removed can includes adhesive backing, for example to be adhered to packages or documents related to package shipment. Alternately, the removed portions can be free of adhesive such that they can be used for filing or used as postcards for mailing acknowledgements and the like. The removed portions normally carry information in human readable format, machine readable format, or both human and machine readable formats for identifying the package, the shipper, the addressee or some combination of the three.

Where the removed portions are to be adhered to a package, document or the like, an adhesive is provided on one surface such that the removed portions perform as self-sticking labels. Most commonly, the adhesive is a pressure sensitive adhesive with a readily removable release material covering the adhesive until the appropriate time for removal and application to a package or document. Alternately, the adhesive may be a remoistenable adhesive which is activated by the application of moisture.

Figure 3:
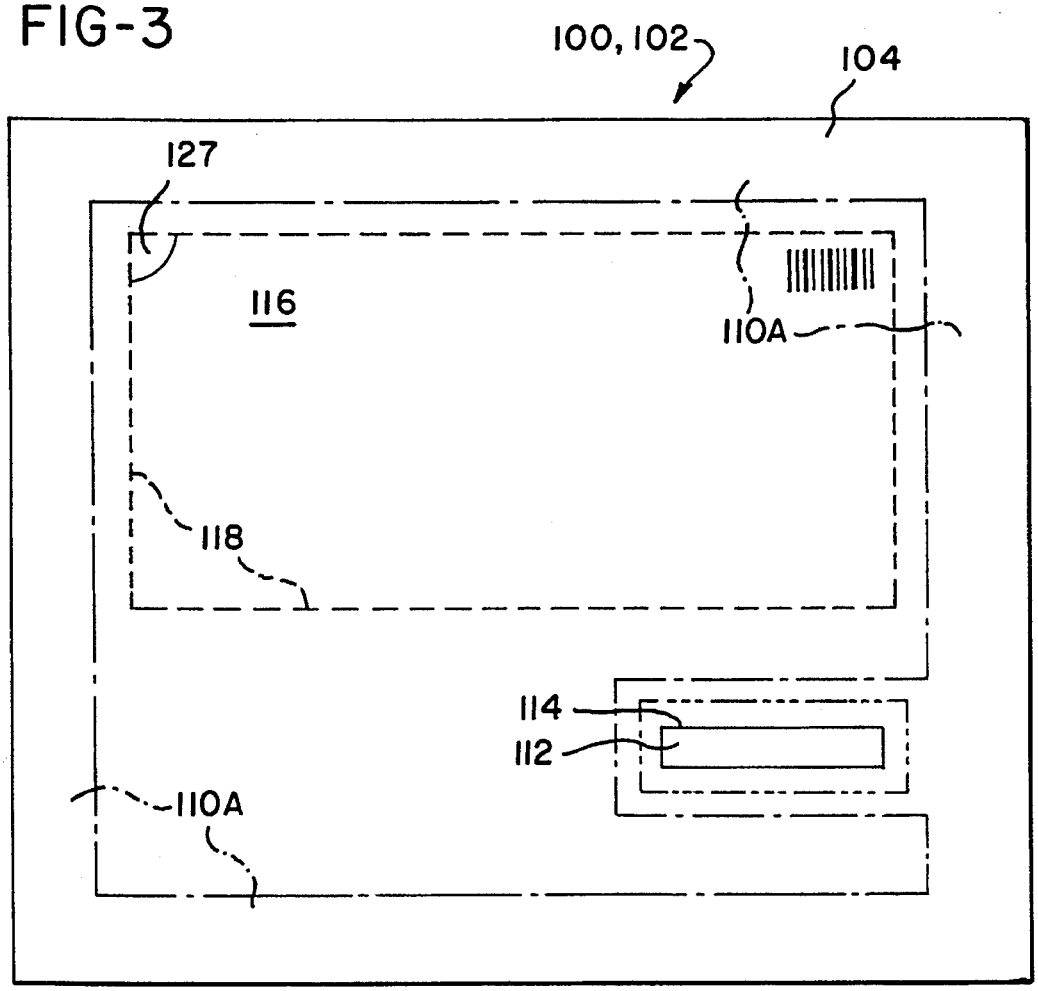
FIG. 3 is a front view of a label of the present invention.

Reference is now made to FIGS. 1 and 2 of the drawings which illustrate a three-ply embodiment and a two-ply embodiment, respectively, of the present invention. The label 100 of FIG. 1 is a three-ply laminate comprising a top ply 104, a bottom ply 106 and a release liner ply 108. The top ply 104 a first portion which has its underside coated with an adhesive 110, preferably a pressure sensitive adhesive. A first part of the first portion is coated with the adhesive 110 in a pattern which defines a border 110A, see FIG. 3, around the perimeter or outer periphery of the four sides of the generally rectangular top ply 104. Alternatively, the adhesive may be present along only two sides, preferably opposite sides, leaving the other two sides unadhered. The adhesive 110 is also coated onto the underside of a second part of the first portion of the top ply 10, i.e., at a tab portion 112 of the top ply 104 which is defined by a generally rectangular die cut 114 to be readily separable from the remainder of the top ply 104.

Figure 4:
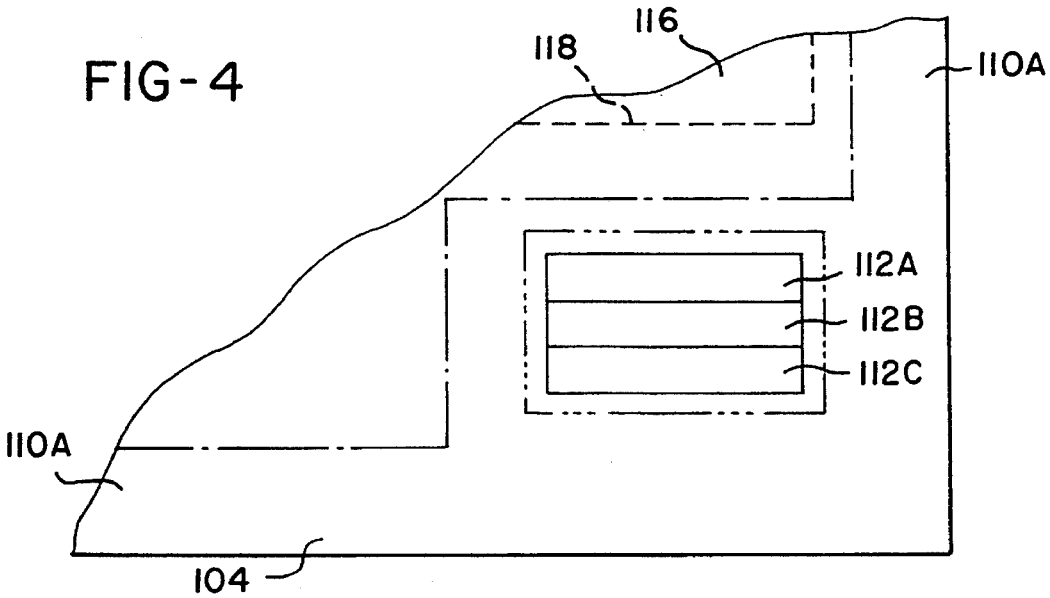
FIG. 4 is a fragmented view of the lower right-hand corner of a label having three removable tab portions or labels.

The adhesive 110, coated onto the underside of the tab portion 112, is shown as extending from the border of the adhesive 110 coated around the outer periphery of the underside of the top ply 104 in a peninsular fashion. However, this portion of the adhesive 110 could be separated from the remainder of the adhesive 110 or include another label or extension as shown for example in FIG. 4. The tab portion 112 of the top ply 104 could also be defined by a series of perforations or other line of weakness such that it is readily separable from the remainder of the top ply 104. If more than one adhesive backed label is required for a given application, additional tab portions can be provided anywhere within the periphery of top ply 104, but preferably adjacent to the tab portion 112. For example, see FIG. 4 wherein three tab portions 112A, 112B and 112C are provided. Any reasonable number of additional tab portions can be provided in a label of the present invention. It should be appreciated that in some applications it may be preferred that adhesive 110 on the underside of tab portion 112 cover less than the entire area of tab portion 112.

A card portion 116 is also defined within the top ply 104 by a line of perforations 118 such that the card portion 116 is readily separable from the top ply 104. The line of perforations 118 lies entirely inside the inner periphery of the adhesive 110 such that when the card portion 116 is removed from the top ply 104, it is completely free of adhesive. Accordingly, the card portion 116 may be used as a postcard, file entry, acknowledgement or for similar applications relative to the business operations being assisted by use of the label 100. It will be appreciated that if the top ply is adhered to the bottom ply only along two sides of the plies, perforations are needed only along and adjacent those two margins.

The bottom ply 106 has adhesive 120 on its underside. The adhesive 120 is shown as coating substantially the entire underside of the bottom ply 106; however, the adhesive 120 can also be coated in a pattern sufficient to secure the label 100 to a package being shipped. If adhesive 120 is a pressure sensitive adhesive then a release liner ply 108 is releasably adhered to the bottom ply 106 by means of pressure sensitive adhesive 120 to permit easy handling of the label 100 until the label 100 is to be adhesively secured to a package. The release liner ply 108 is coated on its upper side 122 with a silicone polymer to permit easy release of the release liner ply 108 from the pressure sensitive adhesive 120. If adhesive 120 were to be a water-activated adhesive, release liner ply 108 would not be needed.

The bottom ply 106 may have a tab release portion 124 on a first section which is also coated with a silicone polymer for release of the adhesive 110 on the underside of the tab portion 112. The tab release portion 124 is accordingly located in register with the tab portion 112 on the underside of the top ply 104. The tab release portion 124 is preferably slightly larger than the tab portion 112 and circumscribes the die cut 114. It will be appreciated that while die cut 114 is illustrated as generally rectangular, another shape may be utilized, if desired. The bottom ply 106 also has a second section without release material which generally underlies the first part of the first portion of the top ply 104. The first and second sections define a portion of the bottom ply 106 that is substantially coextensive with the first portion of the tope ply 104.

For use in package shipping operations, package identification indicia 126 is printed on the label 100. As illustrated, the identification indicia is printed as a machine readable bar code and is shown on the card portion 116. The identification indicia in either machine readable form, human readable form, or both may also be printed onto the top ply 104 in an area exterior to the card portion 116 and also in the tab portion 112 or tab portions such as the tab portions 112A, 112B and 112C, if more than one tab portion is provided. For the label 100 of FIG. 1, the identification indicia 126 can also be transferred to the bottom ply 106 by means of transfer material such as a carbonless transfer material which could be coated onto appropriate portions of the underside of the top ply 104.

As should be apparent, the release liner ply 108 is peeled away from the bottom ply 106 and the remaining two-ply laminate is adhered to a package by means of the adhesive 120. At the appropriate processing stage, the card portion 116 is removed by tearing it away from the top ply 104 along the perforation line 18. A cut-out portion 127 can be provided at one corner, as illustrated, or elsewhere along the perforation line 118 to facilitate removal of the card portion 116.

At another appropriate processing stage, the tab portion 112 is removed from the top ply 104 and the bottom ply 106 and adhered to a document or other appropriate surface by means of the adhesive 110 on the underside of the tab portion 112. The tab release portion 124 of silicone polymer coated onto the upper side of the bottom ply 106 permits easy release of the adhesive 110 on the underside of the tab portion 112. A cut-out similar to the cut-out portion 127, a tab or other arrangement known in the art can be associated with the tab portion 112 to facilitate removal if desired. The upper side of the bottom ply 106 may be preprinted with the name of the shipper, a company logo or other promotional-type information which is exposed when the card section 116 is removed for use.

The alternate two-ply embodiment 102 of the present invention as shown in FIG. 2 is even less expensive than the label 100 of FIG. 1. Since the top ply of the label 102 is substantially identical to the top ply 104 of the label 100, the top ply will be identified by the same reference numeral 104 as will its component parts.

In the two-ply embodiment, the adhesive 120 and liner ply 108 are eliminated, significantly reducing its cost. The two-ply embodiment may be preferred if promotional information to be exposed by removal of the card portion 116 is not desired or if the label 102 could be sufficiently accurately placed on a package such that the card portion 116 covered similar information already printed on the package.

In the two-ply embodiment, silicone polymer release material of the tab release portion 124A is expanded to include substantially the entirety of the pattern 110 of the adhesive on the underside of the top ply 104. However, the tab release portion 124A of the bottom ply 106A of the label 102 is now separated from the remainder of bottom ply 106A by a die cut 130.

The two-ply embodiment of FIG. 2 is used in the same way as the three-ply embodiment of FIG. 1: The bottom ply 106A including the release material is peeled away from the remainder of the label 102, leaving the tab release portion 124A adhering to the portion of the adhesive 110 under the tab portion 112. The remaining top ply 104 is adhered to a package by means of the adhesive 110. The card portion 116 and tab portion 112 are again removed at the appropriate stages as in the previous embodiment. The tab release portion 124A facilitates release of tab portion 112 since it remains positioned between the adhesive 110 on the package surface. When the card portion 116 is removed, a portion of the package surface is exposed, rather than a portion of the bottom ply 106 as in the three-ply embodiment of FIG. 1. Here again, if the label is properly positioned over a preprinted panel on the package, promotional material can be exposed by removal of the card portion 116.

The most common use of labels of the present invention requires the entire label to be affixed to another surface such as a package after peeling away the bottom most ply. However, it should be apparent that the label of the present invention can also be used in other applications wherein the bottom ply is never peeled away and the remainder of the label is not adhered to another surface.

A number of variations will be apparent to one skilled in the art from the foregoing description. For example, the plies of the labels may be made from paper or other fibrous sheets or non-fibrous polymer or any other convenient material, and may range in weight from 10 lbs. to 150 lbs. per ream of material (17"×22"×500"). Adhesives may be pressure sensitive, remoistenable or heat activated and may be chosen from any convenient type including water based, solvent based, hot melt, or 100% solids. Further, labels of the present invention may be manufactured as separate individual labels or they may be adhered to one another in a continuous web separated by perforations. If individually manufactured, the labels may be carried on a continuous web for ease of handling in a given application.

It will be apparent to one of ordinary skill in the art that one or more additional plies may be incorporated between the bottom ply 106 and the release liner ply 108 of FIG. 1. In such a case, adhesive 120 would preferably be a releasable adhesive as taught by Doll et. al. in U.S. Pat, No. 5,039,652. An additional ply would thus be releasably attached to the under surface of bottom ply 106 of FIG. 1, and would in turn be coated with adhesive 120 on its under side. Of course, if adhesive 120 is the water activatable type, release liner 108 is eliminated.

Having thus described the invention of the present application in detail and by reference to preferred embodiments thereof, it will be apparent that still further modifications and variations are possible without departing from the scope of the invention defined in the appended claims.

What is claimed is:

1. A label form comprising:

a first sheet having a first portion on a first surface thereof entirely coated with an adhesive;

a second sheet located adjacent to said first sheet and having a second portion on a second surface thereof which is positioned adjacent to said first portion, said second portion being substantially coextensive with said first portion and having a first section coated with release material and a second section without release material.

2. A label form as set forth in claim 1, wherein said first section underlies a removable section of said first portion.

3. A label form as set forth in claim 2, wherein said removable section is provided with identification indicia.

4. A label form as set forth in claim 1, wherein said first section underlies first and second removable sections of said first portion.

5. A label form as set forth in claim 1, wherein said adhesive is a pressure-sensitive adhesive.

* * * * *